United States Patent [19]

Damiano

[11] 3,957,337

[45] May 18, 1976

[54] MINIATURE ELECTRICAL CONNECTOR HAVING CONTACT CENTERING MEANS

[75] Inventor: Ralph R. Damiano, Naugatuck, Conn.

[73] Assignee: Litton Systems, Inc., Beverly Hills, Calif.

[22] Filed: Feb. 21, 1975

[21] Appl. No.: 551,704

[52] U.S. Cl. ..... 339/217 S; 339/221 R

[51] Int. Cl.[2] ..... H01R 9/08

[58] Field of Search ..... 339/217 R, 217 S, 221 R, 339/221 M, 220 R, 220 T

[56] References Cited

UNITED STATES PATENTS 3,783,440 1/1974 Karube et al. ..... 339/217 S

FOREIGN PATENTS OR APPLICATIONS 567,798 3/1945 United Kingdom ..... 339/217 S

*Primary Examiner*—Joseph H. McGlynn
*Assistant Examiner*—James W. Davie
*Attorney, Agent, or Firm*—M. Michael Carpenter; Alan C. Rose; Alfred B. Levine

[57] ABSTRACT

A miniature electrical connector is shown having an insulated housing with a bore passing therethrough including a large passageway and a reduced passageway joined by an inwardly tapering surface. A contact is received by the passageway having three uniformly spaced, triangular based protrusions whose sides form a sharp tapered edge which tapers at a greater angle than the inwardly tapered surface of the passage for engaging that surface as the contact is inserted therein. The contact is provided with leaf spring latches which snap outwardly once beyond the reduced portion of the passageway to prevent the unauthorized removal of the contact therefrom. The uniformly spaced protrusions having sharp edges tapering at a greater angle than the inwardly tapering surface of the passage cause the contact to be self-centering while stably retaining the contact within the passageway.

8 Claims, 6 Drawing Figures

MINIATURE ELECTRICAL CONNECTOR HAVING CONTACT CENTERING MEANS

BACKGROUND OF THE INVENTION

The present invention relates to electrical connectors and, more particularly, to electrical connectors having at least one contact which is removably retained within a connector housing by means capable of centering and stably retaining the contact.

In the electrical connector art, it is known to utilize a stamped sheet metal contact within an insulated housing. An example of such a sheet metal contact is shown in U.S. Pat. No. 2,689,337 by H. H. Burtt et al. The contact shown is stamped and rolled from a metal sheet to include two leaf springs which engage an internal shoulder formed in a bore passing through the insulated housing and a second stop tab which engages an outer shoulder formed by the bore at the surface of the housing.

In U.S. Pat. No. 3,178,673 by J. H. Krehbiel, a sheet metal contact is shown which is used for a so-called 0.093 series electrical connector. Here, the contact is retained within a cylindrical bore in an insulated housing by leaf springs which engage a shoulder formed in the bore and wing flanges which engage a second shoulder on the opposite side of the bore from the first-mentioned shoulder. The contact also has two flared skirts formed by flaring the edge of a longitudinal slot in the contact, and a protruding rib which engage the parallel surfaces of the bore to provide contact centering. In this arrangement, as the contact is inserted into the bore, there must be a clearance between the distance from the stop provided by the wing flanges and the leaf springs and the distance from the first and second shoulders in order for the leaf springs to snap outwardly for retention of the contact within the housing bore. Once installed, the contact is free to rotate about its longitudinal axis and to move along its longitudinal axis within the clearance required to permit the leaf springs to function properly. This rotation and forward to backward motion decreases the stability of the contact. The contact is also free to rock from side to side about a fulcrum formed by the skirts as they contact the bore due to the clearance mentioned above and due to the uneven distribution of the two flared skirts and protruding rib within the cylindrical bore.

A second electrical contact by Krehbiel is shown in U.S. Pat. No. 3,465,279 which is utilized within a so-called 0.062 series electrical connector. This contact is latched by the interaction of leaf springs on one side of a cylindrical bore and two protruding flange portions flared from a slot edge and a square flange on the other side. The centering action is obtained by a longitudinal rib. This contact is again prone to forward and backward motion due to the stop provided by the square flange, in spite of the tapering arrangement of the two flared flanges which engage a square shoulder in the bore. Rocking due to the close proximity of the two flared flanges also remains a problem.

In U.S. Pat. No. 3,790,923 by I. Mathe a similar electrical connector to the connectors discussed above is shown having three key-like embossments equally distributed about the periphery of the contact. These embossments form square shoulders which cooperate with an internal square shoulder formed within a cylindrical bore passing through the connector housing.

This same bore has a second square shoulder which is engaged by a latch spring and two flanges flared from the lateral edge of a longitudinal slot. As before, this contact has a tendency to move forward and backward within the housing due to the clearance required to free the latch springs during the insertion of the contact into the housing. Contact centering is provided and rocking is prevented by a large diameter resilient collar which has a slight press fit with the enlarged portion of the housing bore.

A final electrical connector which should be considered as background of the invention is shown in U.S. Pat. No. 3,783,440 by S. Karube et al. In this electrical connector, the contact is retained within the housing bore by leaf springs which engage a square shoulder, while it is retained against motion in the opposite direction by a tapered bellmouth contact portion which engages a tapered surface within the housing bore having the same taper angle. A resilient hook is also provided to retain the contact against motion in the opposite direction. While the arrangement of two identical tapers provides adequate centering, it should be noted that the area required by each contact is somewhat larger than the prior art because of the bellmouth configuration. Further, the insertion force required to insert the two equal tapers against each other until the leaf springs are clear of the square shoulder is substantial. In FIG. 8 of the Karube reference three cut-up protrusions are shown which may be used in place of the resilient bellmouth portion. These cut-up protrusions are said to provide spring resilience when inserting the contact into the housing. In practice, however, these protrusions have little, if any, resilience. It is necessary to shear the cut-up protrusions into the sheet metal contact prior to rolling the contact into the desired shape. The cone configuration of the bellmouth contact with the three cut-up protrusions shown is difficult to manufacture. Further, the flat outer surface of the cut-up protrusions forms a three-surface contact area with the tapered housing bore which does not readily yield when configured as shown and thus requires a clearance between the contact surface and the ends of the leaf springs. Therefore, the undesirable forward to backward motion of the contact within the housing is still possible.

SUMMARY OF THE INVENTION

The present invention seeks to improve upon the electrical connector housing and contact mounting arrangements discussed hereinabove by providing a contact and housing configuration which permits the contact to be removably retained and stably centered within a housing passageway through the utilization of three equally spaced triangular based detents having two side walls which join together at a sharp edge that tapers at an angle greater than an internally tapering surface in the housing passageway.

Accordingly, it is an object of the present invention to provide an electrical connector with a contact mounting arrangement that improves the stability of the contact, centers the contact and eliminates front to back motion of the contact within the connector housing.

A further object of the invention is to provide an electrical connector with a contact that does not require a large outer diameter in order to provide contact centering.

A still further object of the invention is to provide a contact that can be easily and economically fabricated.

Other objects and further advantages of the present invention will become apparent to those skilled in the art after careful consideration of the specification and drawings, wherein:

BRIEF DESCRIPTION OF THE PREFERRED EMBODIMENT

Figure 1:
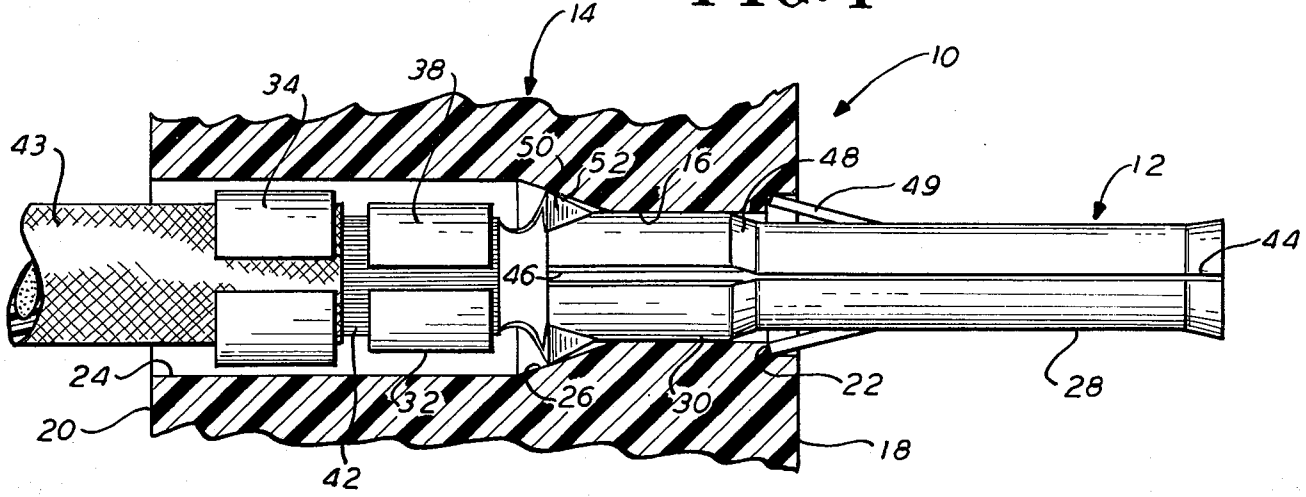
FIG. 1 is a plane elevational view of a female contact embodying the present invention crimped upon a wire and mounted within a housing shown in cross section.

Referring now to the drawings, an electrical connector 10 is shown in FIG. 1 including a conductive contact 12 constructed from a sheet of metal stamped and rolled into the configuration shown. An insulated connector housing 14 having at least one passageway 16 extending therethrough from a front surface 18 to a back surface 20 receives and retains the contact 12. The passageway 16 is counterbored at the front surface 18 to form a square-shouldered surface 22 which is perpendicular to the longitudinal axis of a passageway 16. From the back surface 20 the passageway 16 is enlarged to form a wire receiving chamber 24. The larger wire chamber 24 merges with the first-mentioned, smaller passageway 16 through an inwardly tapering surface 26 which completes the passage through the contact housing 14.

Figure 5:
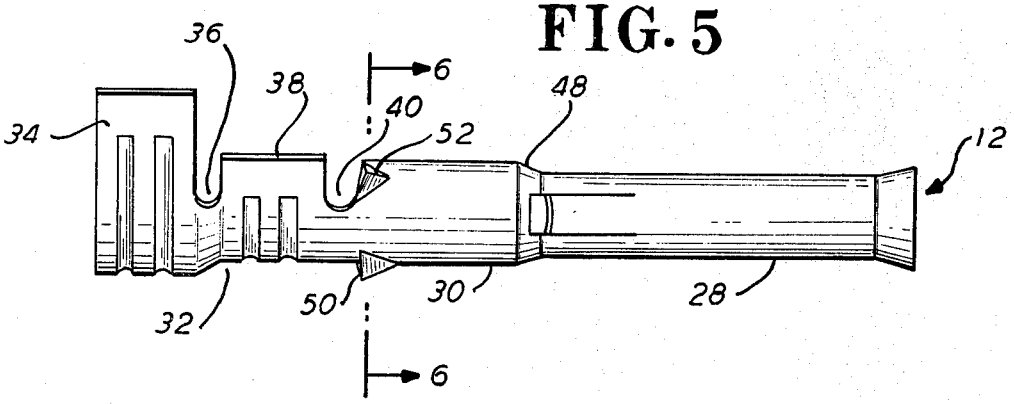
FIG. 5 is a side elevation showing the female contact of FIG. 4.

The female contact shown in FIG. 1 comprises three sections, including a frontmost contact mating section 28, a central housing latch section 30 and an open barrel crimp section 32. As better seen in FIG. 5, the open barrel crimp section 32 includes a first pair of generally U-shaped arms 34 connected by a reduced section 36 to a second pair of shorter U-shaped arms 38. The arms 38, in turn, are connected by a second reduced section 40 to a rolled cylindrical tube which forms the housing latch section 30. In use, a conductive wire 42 stripped at one end of its insulation 43, FIG. 1, is inserted into the open barrel crimp section 32 which is then closed upon the wire by a suitable crimping tool, not shown, by closing the arms 34 upon the insulation 43 while closing the arms 38 upon the stripped conductive portion of the wire 42.

The contact 12 is formed with a slot 44 extending longitudinally along the periphery as the sheet metal from which the contact is fabricated is rolled into a cylindrical tube. The longitudinal slot 44 is enlarged through the housing latch section 30 at slot opening 46 to provide resiliency to the housing latch section. This slot enlargement terminates at a transition zone 48 formed by the tapering of the cylindrical housing latch section 30 as it is reduced in diameter to provide for the formation of a pair of leaf springs 49, each of which is integrally connected to the latch section 30 and folds back toward the transition zone to terminate slightly before that zone.

Figure 6:
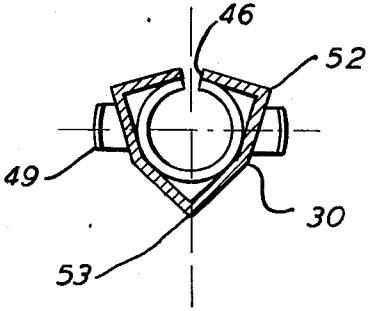
FIG. 6 is a cross-sectional view taken along lines 6—6 of FIG. 5.

At the jointure between the open barrel crimp section 32 and the housing latch section 30, three equally spaced triangular based protrusions 50 are provided for engagement with the inwardly tapering surface 26 when the contact 12 is in its latched position. These triangular protrusions 50 are formed by stamping a triangular base into the peripheral surface of the sheet metal which forms the housing latch section 30. Each resulting two-sided protrusion 50 has a sharp edge 52 which tapers outwardly from the surface of the latch section 30 to terminate at a point 53, as best seen in FIG. 6. Obviously, edge 52 may be slightly radiused to facilitate fabrication.

It will be seen in FIG. 6 that the three triangular based protrusions 50 are arranged at 120° apart about the periphery of the housing latch section 30. However, a careful review of FIG. 1 will disclose that the protrusions 50 are shown in that figure 180° apart. The reason for this showing is to illustrate the cooperation between the outwardly tapering sharp edge 52 of the triangular based protrusions 50 and the inwardly tapering surface 26 of the passageway 16 which tapers at a lesser angle. As the contact 12 is inserted into the passageway 16, the pair of leaf springs 49 on opposite sides of the housing latch section 30 are inwardly displaced by the tapering surface 26. Further insertion of the contact 12 into the passageway 16 allows the leaf springs 49 to spring outwardly into the cavity formed by the counterbore which forms the shoulder 22. The sharp edge 52 of each triangular based protrusion 50 engages the tapering surface 26 to squeeze the housing latch section 30 and reduce the space of the resilient slot 46 as the sharp edges 52 bite into the tapered surface 26 of the insulated housing. One the leaf springs 49 have snapped behind the shoulder 22, the contact 12 will be urged back against the ends of each spring by the interaction of the tapered edges 52 against the tapered surface 26 under the urging of the housing latch section 30.

Figure 2:
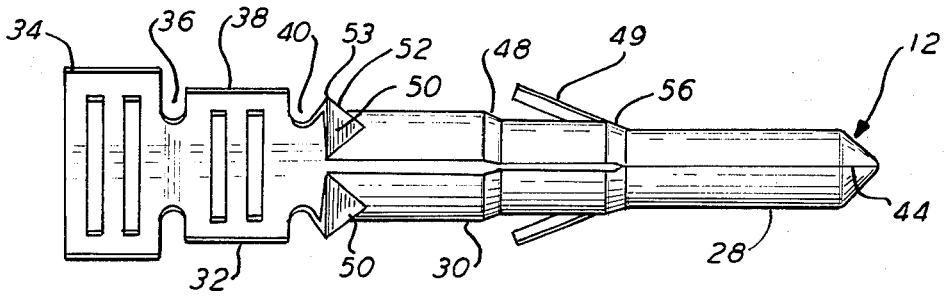
FIG. 2 is a plane elevational view of a male contact embodying the present invention prior to being crimped upon a wire.
Figure 3:
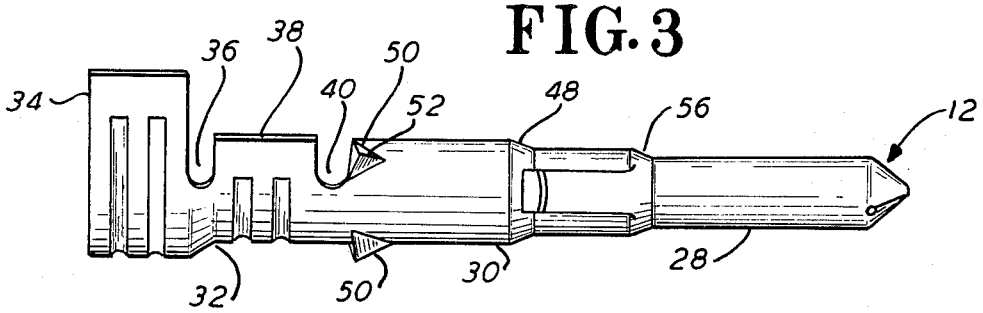
FIG. 3 is a side view showing the male contact of FIG. 1.
Figure 4:
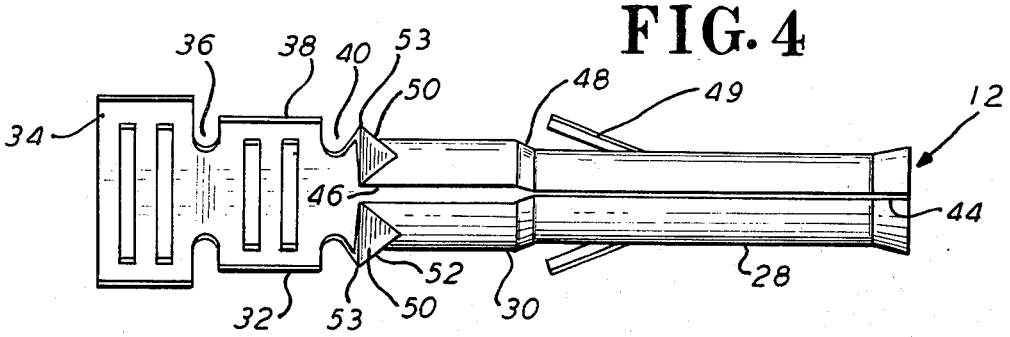
FIG. 4 is a plane elevational view showing a female contact of the present invention.

A male contact is shown in FIG. 2 with the contact mating section 28 starting at a second transition zone 56 slightly in front of the leaf springs 49. It should be noted that the resilient slot 46 does not terminate at the first transition zone 48 in the male contact but is reduced in size and extended to the second transition zone 56 where it is terminated by the line-to-line mating of the sheet metal which forms the slot 44 that runs the full length of both sections 28 and 30. The male contact shown in FIGS. 2 and 3 is similar to the female contact shown in FIGS. 4 and 5, with the exception of the configuration of the contact mating section 28. Further, the forward-most end of the female contact mating section 28 is outwardly flared to more conveniently receive the male contact mating section shown in FIGS. 2 and 3.

The contact thus described has a smaller overall diameter than some prior art contacts. Due to the sharp tapered edges 52 of the triangular based protrusions 50 equally arranged about the perimeter of the housing latch section 30, the contact edges 52 cut or bite into the insulated housing and its tapered surface 26. The degree of the cut or bite depends upon the insulated material from which the housing is molded. This biting effect, combined with the resilient compression allowed by the slot 46, allows the contact 12 to be inserted until the leaf springs 49 snap outwardy to engage the shoulder 22 and then retains the contact 12 without a forward to backward motion. The engagement of the sharp tapered edges 52 into the less steeply tapered surface 26 also prevents rotation of the contact about either longitudinal or lateral axes to provide a stable contact mating arrangement within the housing passageway. Due to this arrangement, the dimensions between the point where the sharp tapering edges 52 engage the inwardly tapering surface 26 and the point where the ends of the latches 49 engage the shoulder 22 are not critically toleranced.

The embodiments of the invention in which an exclusive property or privilege is claimed are defined as follows:

1. An electrical connector having contact centering means, comprising:

an insulated housing having a front and a rear surface and a passageway between said surfaces, said passageway radially enlarged from said rear surface toward said front surface to form a contact receiving chamber which is merged with said passageway by an inwardly and forwardly tapering surface;

a sheet metal contact rolled to form a contact mating section, a housing latch section, and an open barrel crimp section mounted within said passageway;

said housing latch section including leaf spring means directed toward the rear of said contact which yield as said contact passes through said passageway and snap out from said passageway as said spring means clear said front housing surface to prevent rearward movement of said contact; and said housing latch section further including three triangular based protrusions, each protrusion having sides extending from said rolled sheet metal surface which terminate in a generally sharp outwardly and rearwardly tapering edge, and each protrusion equally spaced about the periphery of said housing latch section, said outward and rearward taper being at a greater angle than said forward and inward taper of said passageway surface wherein said sharp tapering edges engage and deform said tapering surface of said housing to prevent further forward movement of said contact, to prevent rotational movement of said contact, and to center said contact within said housing.

2. An electrical connector as claimed in claim 1 wherein said sheet metal contact is rolled to form a cylindrical tube having a longitudinal slit running through said contact mating section and said housing latch section which is enlarged through said housing latch section to provide resiliency to said latch section, and two of said three triangular based protrusions are equally spaced from said enlarged slit and each is spaced one hundred and twenty degrees from the other.

3. An electrical contact as claimed in claim 1 wherein said contact mating section includes a cylindrical tube having a radially outwardly flared end to form a female contact.

4. An electrical contact as claimed in claim 1 wherein said contact mating section includes a cylindrical tube closed at its end to form a male contact.

5. An electrical contact as claimed in claim 1 wherein said insulated housing is provided with a plurality of passageways for mounting a plurality of contacts.

6. In an electrical connector having an insulated housing with a passageway therethrough and a tubular shaped electrical contact mounted therein with leaf spring means to prevent the unauthorized removal of said contact after insertion into said passageway, the improvement comprising:

said passageway including a converging portion having an inwardly tapering surface;

said tubular contact including three equally spaced, triangular based protrusions extending from said tubular surface, each having two side walls terminating at a sharp edge tapering at an angle from the surface of said tubular contact to a point which is greater than the angle of said inwardly tapering surface wherein said tapered edges engage said tapered surface at three points.

7. In an electrical connector as claimed in claim 6, the improvement additionally comprising forming said housing of a deformable insulation material and deforming said tapered surface by said tapered edges as said contact is inserted into said passageway to prevent movement of said contact.

8. In an electrical connector as claimed in claim 7, the improvement additionally comprising forming said tubular electrical contact with a longitudinal slit along the periphery thereof and placing one of said three triangular based protrusions opposite said slit with said remaining two protrusions spaced one hundred and twenty degrees therefrom.

* * * * *